US005711224A

United States Patent [19]

Becker

[11] Patent Number: 5,711,224

[45] Date of Patent: Jan. 27, 1998

[54] DEVICE FOR FASTENING A CLAMPING BAR

[75] Inventor: Willi Becker, Bammental, Germany

[73] Assignee: Heidelberger Druckmaschinen AG, Heidelberg, Germany

[21] Appl. No.: 642,621

[22] Filed: May 3, 1996

[30] Foreign Application Priority Data

May 3, 1995 [DE] Germany ..... 295 07 330 U

[51] Int. Cl.[6] ..... B41F 1/28

[52] U.S. Cl. ..... 101/415.1

[58] Field of Search ..... 101/415.1

[56] References Cited

U.S. PATENT DOCUMENTS

| | | | |
|---|---|---|---|
| 1,582,390 | 4/1926 | Evans | 101/415.1 |
| 3,599,565 | 8/1971 | Feier et al. | 101/116 |
| 3,675,573 | 7/1972 | Hawks | 101/415.1 |
| 3,844,214 | 10/1974 | Smith | 101/415.1 |
| 3,994,224 | 11/1976 | Hill | 101/415.1 |
| 4,108,069 | 8/1978 | Standiford | 101/415.1 |
| 5,337,666 | 8/1994 | Becker | 101/415.1 |

FOREIGN PATENT DOCUMENTS 4222332 1/1994 Germany .

*Primary Examiner*—Edgar S. Burr
*Assistant Examiner*—Amanda B. Sandusky
*Attorney, Agent, or Firm*—Herbert L. Lerner; Laurence A. Greenberg

[57] ABSTRACT

Device for fastening a clamping bar for clamping a covering to a clamping shaft formed with a groove wherein the clamping bar engages, including a spring-loaded retainer disposed on the clamping shaft and engaging in the clamping bar, the device further including a locking element radially displaceable in the clamping shaft.

9 Claims, 3 Drawing Sheets

DEVICE FOR FASTENING A CLAMPING BAR

BACKGROUND OF THE INVENTION

Field of the Invention

The invention relates to a device for fastening a clamping bar which is employed for holding and clamping coverings, such as rubber blankets on rubber blanket cylinders of offset printing presses.

The published German Patent Document DE 42 22 332 A1 discloses a device for fastening a rubber blanket on a rubber blanket cylinder of an offset printing press, wherein the ends of the rubber blanket are clamped in clamping bars, which are fastened, in turn, to clamping shafts. The clamping bars, respectively, are formed with a projection wherein a shoulder of the clamping bar is engageably disposed. To prevent the clamping bar from being pivoted outwardly from the clamping shaft about the engagement position, a spring-loaded retaining clip is provided.

SUMMARY OF THE INVENTION

It is an object of the invention to provide a device for fastening a clamping bar so as to lock thereby a covering on a clamping shaft in a manner not heretofore contemplated or suggested by the state of the art.

With the foregoing and other objects in view, there is provided, in accordance with the invention, a device for fastening a clamping bar for clamping a covering to a clamping shaft formed with a groove wherein the clamping bar engages, including a spring-loaded retainer disposed on the clamping shaft and engaging in the clamping bar, the device further comprising a locking element radially displaceable in the clamping shaft.

In accordance with another feature of the invention, the locking element is a spring-loaded bolt.

In accordance with a further feature of the invention, the device includes an actuator for the locking element.

In accordance with an added feature of the invention, the actuator is a leaf spring.

In accordance with an additional feature of the invention, the leaf spring is formed with a loop.

In accordance with yet another feature of the invention, the actuator is disposed in an opening formed in the clamping bar.

In accordance with a concomitant feature of the invention, the covering is a rubber blanket, and the clamping shaft and clamping bar are on a blanket cylinder of an offset printing press.

An advantage of the invention is that the retaining clamps can be provided with a very low spring force, so that a human operator can easily actuate them. At the same time, by providing the locking element according to the invention, the clamping bar is prevented from coming loose form the clamping shaft. This provision avoids any possibility of the clamping bar dropping onto other cylinders, such as printing unit cylinders of a printing press, and causing subsequent damage to those cylinders.

In an advantageous construction, an actuator for unlocking the locking element is provided, which assures relatively easy manipulation.

Other features which are considered as characteristic for the invention are set forth in the appended claims.

Although the invention is illustrated and described herein as embodied in a device for fastening a clamping bar, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
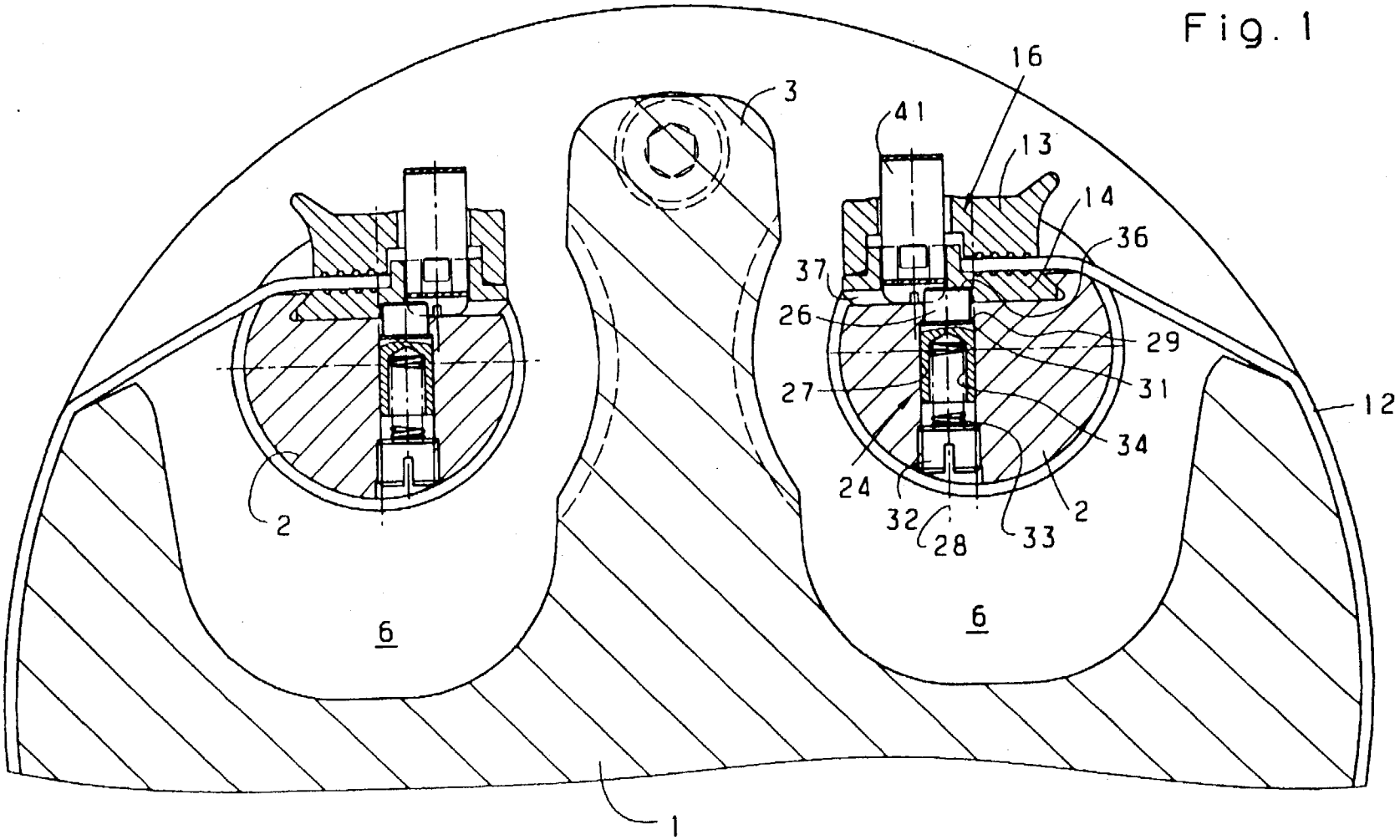
FIG. 1 is an enlarged cross-sectional view of FIG. 2 taken along a line I—I therein, in the direction of the arrows, and rotated 90° clockwise, and showing a rubber blanket cylinder of an offset printing press having the fastening or locking device for a clamping bar according to the invention.
Figure 3:
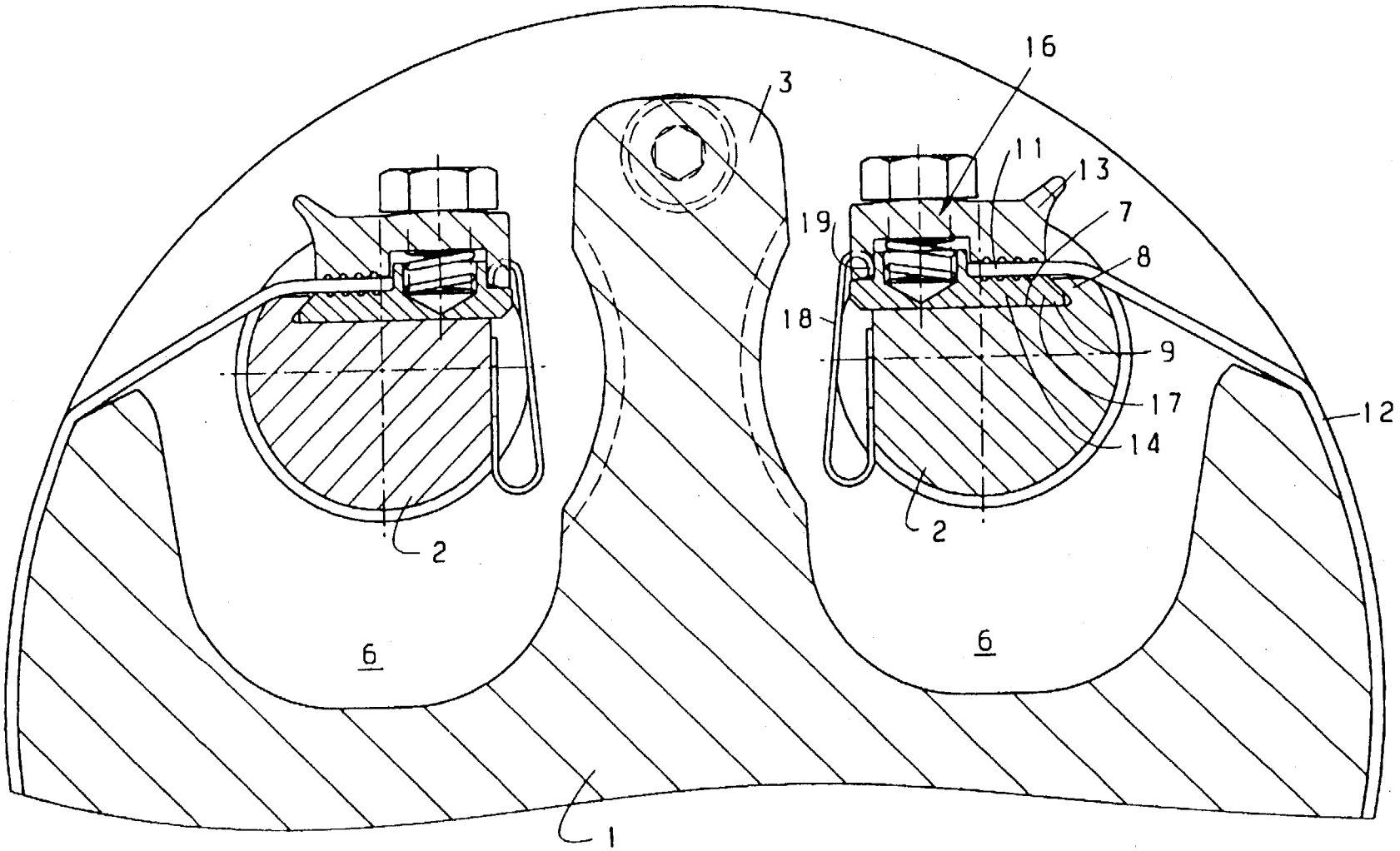
FIG. 3 is an enlarged cross-sectional view of FIG. 2 taken along the line III—III in the direction of the arrows, and rotated clockwise through an angle of 90°.

Referring now to the drawings and, first, particularly to FIGS. 1 and 3 thereof, there is shown therein a rubber blanket cylinder 1 of an offset printing press provided with two clamping shafts 2, respectively, at each of the end faces thereof. By means of a rib or strip 3, an axially parallel gap or trench formed in the rubber blanket cylinder 1 is subdivided into two recesses 6. The clamping shafts 2 are respectively, swivelably disposed in the respective recesses 6. Because the clamping shafts 2 are arranged mirror-symmetrically, the device of the invention will be described hereinafter with respect to only a single clamping shaft 2. The clamping shaft 2 is formed with a flattened surface 7 in an upper region thereof, as viewed in FIGS. 1 and 3. At a region facing towards an open side of the recess 6, the clamping shaft 2 is formed with a projection or protrusion, which extends axially parallel over the length of the clamping shaft 2. With the flattened surface 7, the protrusion or projection 8 forms a groove 9.

Figure 2:
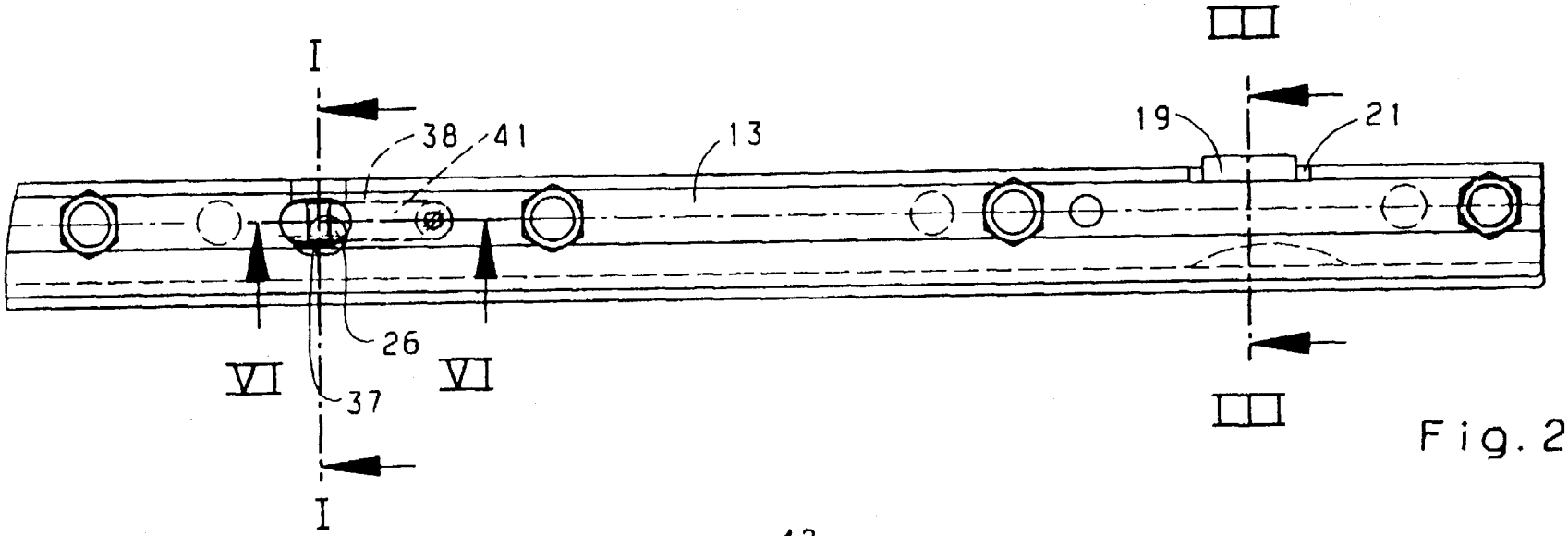
FIG. 2 is a plan view of the clamping bar.

One end 11 of a covering 12, such as a rubber blanket, is clamped between two clamping elements 13 and 14 of a clamping bar 16, which rests on the flattened surface 7 of the clamping shaft 2, and is formed with a shoulder 17 with which it engages in the groove 9. To secure the clamping bar 16 against swiveling away from the clamping shaft 2 about a pivot point located on a surface of the projection 8 defining the groove 9, at least one and preferably two spaced-apart retaining clamps 18 are provided. A spring-loaded retainer 18 in the form of a retaining clamp or retaining clip 18 is secured to the clamping shaft 2 at a side thereof opposite the projection 8. At an upwardly directed end thereof, as viewed in FIG. 3, the retaining clip 18 is formed with a hook 19. The retaining clip 18 itself is bent in the form of a loop and has a spring force which presses the hook 19 over a shoulder 21 (note FIG. 2). A recess in the clamping element 14 of the clamping bar 16 forms the shoulder 21.

As shown in FIG. 3, the clamping bar 16 is fixed on the clamping shaft 2 by the engagement of the shoulder 17 in the groove 9 at a front region of the clamping bar 16 located at the right-hand side of the figure and, in a rear region thereof, by the engagement of the hook 19 and the shoulder 21.

A locking device 24 is provided for securing the clamping bar 16 against displacement on the flattened surface 7 of the clamping shaft 2 counter to the spring force of the retaining clip 18. The locking device 24 has a movable spring-loaded bolt 26, which is mounted in a bore 27 at the bottom of the clamping shaft 2, as viewed in FIG. 1. The bore 27 is formed in the clamping shaft 2 approximately midway along the axial length thereof.

The bolt 26 has a longitudinal axis 28 which is perpendicular to a plane coinciding with the flattened surface 7. The bolt 26 is axially displaceably supported in the bore 27. The bore 27 is a through bore, which has a larger diameter in a lower region thereof remote from the flattened surface 7 than in an upper region thereof, as viewed in FIG. 1. A shoulder 29 located between the upper and the lower regions of the bore 27 acts as a stop for the bolt 26, with which the bolt 26 is engageable by means of a collar 31. A screw 32, which closes off the through bore 27 in a lower region thereof, serves as an abutment or counterbearing for a spring 33, which is braced, at one end thereof, against the screw 32 and, at the other end thereof, against the bolt 26. To achieve stable guidance for the spring 33, the bolt 26 is formed with a bore 34 which extends in the direction of the axis 28, and into which the spring 33 projects. The head 36 of the bolt 26 protrudes beyond the plane of the the flattened surface 7, and one side thereof rests against a side wall defining a recess 37 which is formed in the clamping element 14 of the clamping bar 16.

Figure 4:
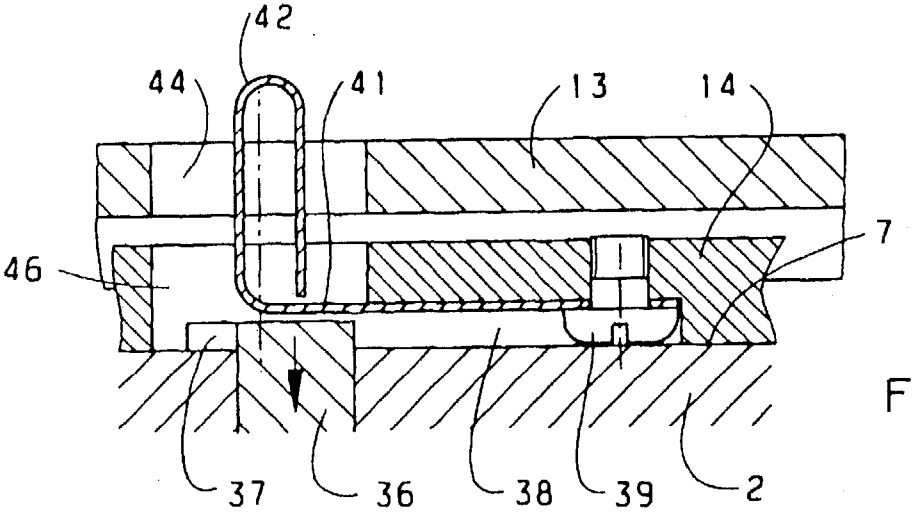
FIG. 4 is an enlarged fragmentary, longitudinal sectional view of FIG. 2 taken along the line VI—VI in the direction of the arrows, and showing the clamping bar with an actuating device forming part of the invention of the instant application.

A resilient actuator in the form of a leaf spring 41 is held by means of a fastener 39 in a further recess 38 formed in the clamping element 14, as shown in FIG. 4. The recess 38 extends in the direction of the clamping bar 16 and intersects the recess 37 in the vicinity of the bolt 26. On an end of the actuator 41 distal from the fastening location thereof, the actuator 41 has an operator element, preferably in the form of a loop 42, at the end of the leaf spring 41. The operator element 42 is disposed above the head 36 of the bolt 26 and is bringable into operative contact therewith counter to the force of the leaf spring 41. The operator element 42 is disposed in openings 44 and 46 formed in the clamping elements 13 and 14, respectively, of the clamping bar 16 and protrudes upwardly out of the clamping bar 16, as viewed in FIG. 4, for such a distance that it is able to be actuated manually, for example.

To secure the clamping bar 16 to the clamping shaft 2, the clamping bar 16 is placed with the underside thereof on the head 36 of the bolt 26, and the latter is pressed counter to the force of the spring 33 so far downwardly into the bore 27 that the clamping bar 16 rests on the flattened surface 7 of the clamping shaft 2. Due to the spring force of the retaining clip 18, the hook 19 is pressed over the shoulder 21 and secures the clamping bar 16 against being lifted from the clamping shaft 2. Then, the clamping bar 16 is displaced so far towards the opening of the recess 6 that the shoulder 17 engages in the groove 9. When the shoulder 17 is correctly engaged in the groove 9, the bolt 26 is automatically thrust upwardly by the force of the spring 33 into the recess 37 until it rests against the side wall defining the recess 37. The clamping bar 16 is thereby secured against displacement.

To release the clamping bar 16 from the clamping shaft 2, the operator element 42 is pressed downwardly towards the clamping shaft 2, as viewed in FIG. 4, counter to the force of the leaf spring 41 and the force of the spring 33, until the bolt 26 has plunged through the periphery of the clamping shaft 2. The clamping bar 16 on the flattened surface 7 can then be displaced so far counter to the force of the retaining clip 18, that the shoulder 19 of the clamping bar 16 disengages from within the groove 21. The clamping bar 16 can then be removed from the clamping shaft 2.

I claim:

1. Device for fastening a clamping bar for clamping a covering to a clamping shaft formed with a groove wherein the clamping bar engages, including a spring-loaded retainer disposed on the clamping shaft and engaging in the clamping bar, the device further comprising a locking radially displaceable in the clamping shaft, said locking element locking said clamping bar against displacement relative to said clamping shaft.

2. Device according to claim 1, wherein said locking element is a spring-loaded bolt.

3. Device according to claim 2, including an actuator for said locking element.

4. Device according to claim 3, wherein said clamping bar has an opening formed therein and said actuator is disposed in said opening.

5. Device for fastening a clamping bar for clamping a covering to a clamping shaft formed with a groove wherein the clamping bar engages, including a spring-loaded retainer disposed on the clamping shaft and engaging in the clamping bar, the device further comprising a locking element radially displaceable in the clamping shaft, and an actuator for said locking element, wherein said actuator is a leaf spring.

6. Device according to claim 5, wherein said leaf spring is formed with a loop.

7. In combination with a blanket cylinder of an offset printing press, a device for fastening a rubber blanket on the blanket cylinder, comprising:

a clamping shaft disposed in a cavity formed in the blanket cylinder of the offset printing press, said clamping shaft having a groove formed therein, a clamping bar engaging in said groove, and a spring-loaded retainer disposed on the clamping shaft and engaging in said clamping bar; and a locking element in said clamping shaft for locking said clamping bar against displacement relative to said clamping shaft.

8. The combination according to claim 7, wherein said locking element is a spring-loaded bolt.

9. The combination according to claim 8, which further comprises an actuator for said spring-loaded bolt.

* * * * *